US005437486A

United States Patent [19]

Hoffman

[11] Patent Number: 5,437,486

[45] Date of Patent: Aug. 1, 1995

[54] ADJUSTABLE WINDOW OR DOOR LOCK

[76] Inventor: Larry D. Hoffman, Rte. 1, Box 2360, Stigler, Okla. 74462

[21] Appl. No.: 216,974

[22] Filed: Mar. 24, 1994

[51] Int. Cl.[6] ..... E05C 17/54

[52] U.S. Cl. ..... 292/339

[58] Field of Search ..... 292/338, 339, 268, 269, 292/DIG. 47; 49/449, 450

[56] References Cited

U.S. PATENT DOCUMENTS

| | | | |
|---|---|---|---|
| 1,635,448 | 7/1927 | Williams | 292/338 |
| 3,420,001 | 1/1969 | Raymon | 49/450 X |
| 3,512,821 | 5/1970 | Savio et al. | 292/305 |
| 3,677,592 | 7/1972 | Navara | 292/DIG. 47 X |
| 3,698,754 | 10/1972 | Means | 292/262 |
| 3,820,285 | 6/1974 | Shiffler et al. | 49/450 |
| 4,358,758 | 11/1982 | Morton | 292/339 X |
| 4,607,253 | 8/1986 | Wooten et al. | 292/339 X |
| 4,792,168 | 12/1988 | Kardosh | 292/339 X |
| 4,927,198 | 5/1990 | Fennell et al. | 292/338 X |
| 5,217,267 | 6/1993 | Yogi | 292/338 |

*Primary Examiner*—Peter M. Cuomo
*Assistant Examiner*—Jerry Redman
*Attorney, Agent, or Firm*—Molly D. McKay

[57] ABSTRACT

An adjustable window lock comprising first and second tubes, one sliding within the second. Mounting plates are provided to attach the lock to the lower window and the upper frame. A spring loaded push button in the inner tube extends through one of a plurality of holes in the outer tube to lock the window partially open. For full opening in an emergency, the top of the lock can be easily released and the lock laid to one side. The lock can be used on sliding doors.

5 Claims, 2 Drawing Sheets

ADJUSTABLE WINDOW OR DOOR LOCK

This invention relates to window and door security, and specifically, to a system for locking conventional single hung windows at adjustable heights.

BACKGROUND OF THE INVENTION

Single hung windows made today include locking systems to make them relatively secure in the fully closed position. A problem occurs when it is desired to lock the lower window partially open while preventing movement of such lower window from the outside.

Adjustable window and sliding door locks have been described. Examples include Savio, et al., U.S. Pat. No. 3,512,821 (1970), Means U.S. Pat. No. 3,698,754 (1972) and Yogi U.S. Pat. No. 5,217,267 (1993). Problems with these include difficult installation, including special tools in some cases. Special tools for operation is undesirable since they may not be available in an emergency.

SUMMARY OF THE INVENTION

Broadly my invention resides in a safety lock for single hung windows comprising first and second tubes, said second tube slidably movable into and out of the first end of said first tube, a plurality of holes positioned lengthwise of said first tube, means to support the second end of said first tube adapted to prevent rotation of said tube about its axis but to permit movement through at least 90 degrees from right angle to said means, a hole near the end of the second tube which is inserted into said first tube, a spring loaded push button adapted to extend through said hole in said second tube and a selected hole in said first tube, and means to engage the second end of said second tube while permitting quick removal therefrom.

More specifically, my invention includes first and second tubes, said second tube slidably movable into and out of the first end of said first tube; a plurality of holes positioned lengthwise of said first tube; holes near the second end of said first tube adapted to receive fastening means therethrough; a first support plate having two flanges, each of said flanges having a hole therein adapted to line up with the holes near the second end of said first tube; a rivet adapted to extend through the holes in said flange and the holes near the ends of the first tube; a hole near the end of the second tube which is inserted into said first tube; a spring loaded push button adapted to extend through said hole in said second tube and a selected hole in first tube; a second support plate having two downwardly projecting flanges, said flanges having aligned holes therein; a second rivet extending through holes in said second support plate; two L-shaped slots in the end of said second tube opposite said hole, said slots adapted to pass axially over said second rivet and rotating to a locked position wherein said push button is aligned with holes positioned lengthwise of said first tube.

For simplicity the apparatus is described as a window lock but it will be apparent that it can be used horizontally on sliding windows and doors.

Many objects and advantages are available with this invention. It is easily installed requiring, at most, a screwdriver. Installation with adhesive strips requires no tools. Operation with a spring loaded push button is a simple matter. Emergency release is quick, not requiring special tools or keys. Other objects and advantages will be apparent to those skilled in the art upon study of this disclosure.

THE DRAWINGS

DETAILED DESCRIPTION

Figure 1:
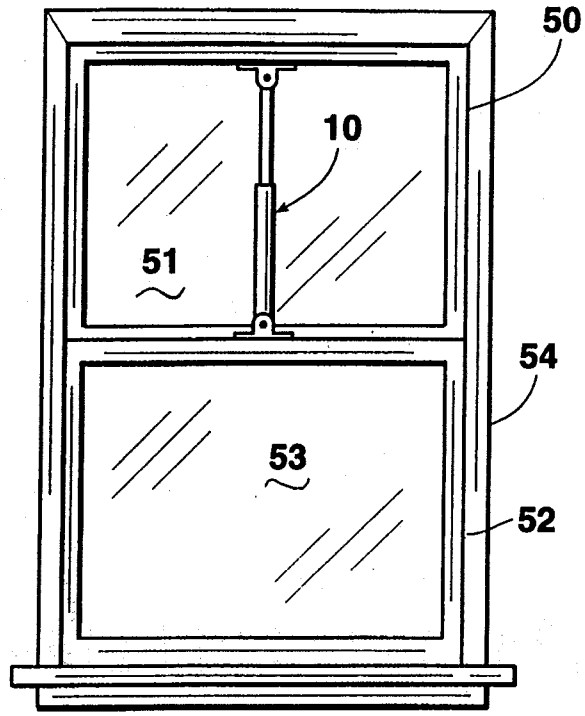
FIG. 1 is a front view of a single hung window with the adjustable window lock in place with the window closed.

For convenience, reference numerals used in the description are herein listed.

10 Adjustable Window Lock
20 Base Plate
21 Adhesive Strip
22 Flanges
24 Rivet
30 Lower Tube End
32 Lock Holes
34 Lower Tube
35 Spring
36 Push Button
37 Hole
37' Fine Adjustment Hole
38 Upper Tube
39 L-Shaped Slot
40 Flange
42 Rivet
46 Upper Plate
48 Screw Hole
49 Adhesive Strip
50 Upper Window Frame
51 Upper Window
52 Lower Window Frame
53 Lower Window
54 Outer Window Frame FIG. 1 shows an adjustable window lock assembly 10 installed on frames 50, 52 of single hung windows 51, 53. The windows are installed in a vertical window frame 54 in modern conventional fashion wherein lower frame 52 and window 53 can be raised or lowered.

Figure 2:
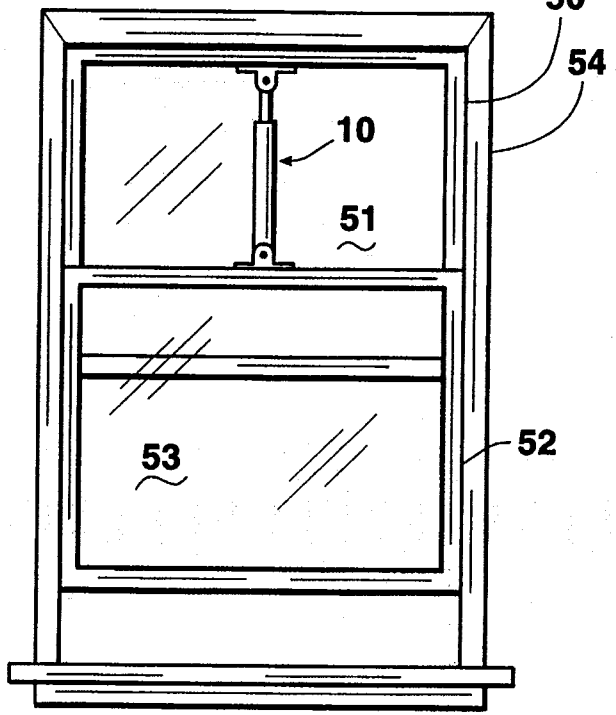
FIG. 2 is a front view of the single hung window with the lower window partially open secured with the window lock.

FIG. 2 shows how window lock 10 can be adjusted to permit lower window 53 to be partially opened at variable distances according to lock holes 32 which allows ventilation while prohibiting opening by an intruder outside the window.

Figure 3:
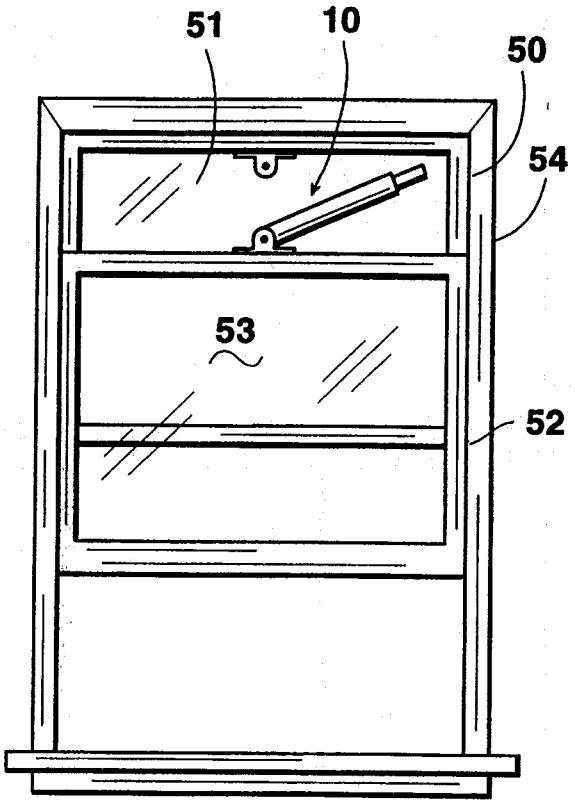
FIG. 3 is a view of the window with the window lock top disconnected to permit the lower window to be fully opened.

FIG. 3 shows the upper end of tube 38 of window lock 10 disconnected permitting full opening of lower window 53.

Figure 4:
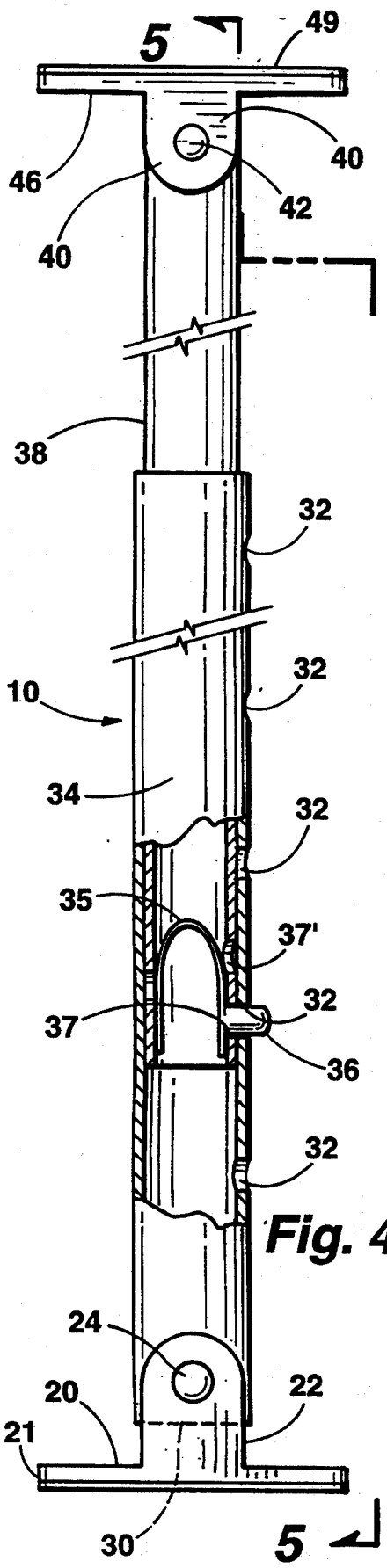
FIG. 4 is a front view of the window lock.
Figure 5:
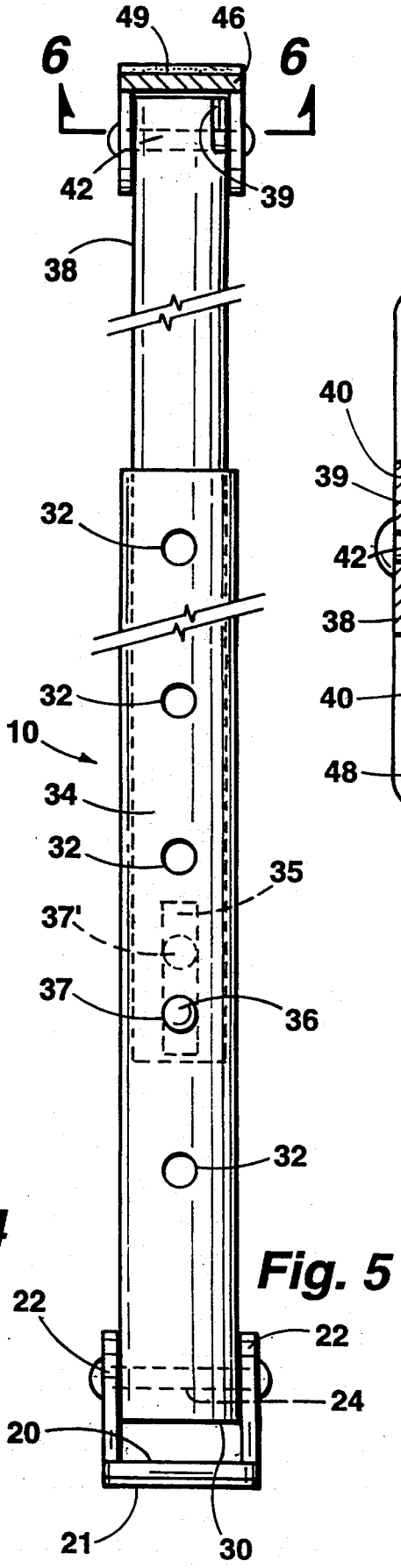
FIG. 5 is a view on Line 5—5 of FIG. 4.
Figure 6:
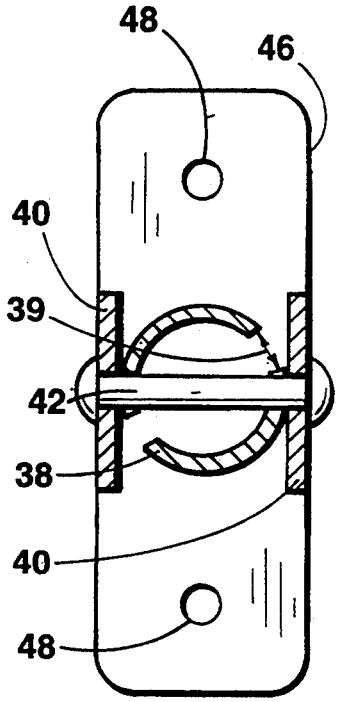
FIG. 6 is a view on line 6—6 of FIG. 5.

FIGS. 4, 5 and 6 show adjustable window lock 10 in detail. This lock has a base plate 20 provided with welded or molded flanges 22 and holes to receive screws (not shown) or an adhesive strip 21 applied to bottom of base plate 20. The shape of flange 22 can be varied. The end 30 of lower tube 34, attached to base plate 20 by rivet 24 has a plurality of lock holes 32, and can swing either left or right. A nut and bolt can be used in place of a rivet. Upper tube 38 contains spring 35 with button 36 attached to one end. Spring 36 is compressed for assembly and inserted inside upper pole 38 and aligned to have button 36 protrude through hole 37 in upper tube 38. Upper tube 38 is inserted into lower tube 34 by depressing push button 36 and sliding the tube downward with a small rotation left or right to keep button 36 depressed. Slots 39 of upper tube 38 are aligned to fit around rivet 42 and between flanges 40 of upper plate 46 which has holes 48 to receive screws (not shown) or adhesive strip 49 applied to flat side of upper plate 46. Upper tube 38 is rotated in the same direction as the bottom of L-shaped slots 39 of upper ple whereas push button 36 will be aligned with a desired hole 32 springing outward into hole thus locking tube 38 in place. The bottom of the L-shaped slot can extend in either direction and the direction is preferably marked on tube 38 to facilitate insertion and release. Adjusting heights are accomplished simply by depressing push button 36 and sliding lower tube 34 upward to open or downward to close until button 36 springs outward into choice of lock holes 32. For fine adjustment a second hole 37' is provided in tube 38 not far from hole 37. For part separation rivets 24 and 42 can be replaced by nuts and bolts.

The manner of using window lock 10 to lock open single hung windows at desired openings for personal comfort and energy efficiency without fear of intruders on outside of window is done simply by depressing push button 36, raising lower window to which base plate 20 is attached, thereby causing lower tube 34 which is attached to base plate 20 by rivet 24 to slide over upper tubular pole 38 until button 36 springs outward into the lock hole 32 at the desired height. To close window, the reverse is exercised. For window to be fully opened or for emergency exit, push button 36 is depressed, upper pole 38 is rotated and pulled down into lower tube 34, and window lock 10 laid to either left or right side. This can be done in a few seconds and does not call for a key or special tools.

Thus, it will be seen that the adjustable window lock of this invention is highly reliable, simple to operate, easy to install, yet economical, and energy efficient, allowing for cost saving ventilation without the fear of intruders outside of window and a rapid release for emergency use requiring no special wrenches or keys.

While my above description contains many specific details, these should not be construed as limitations on the scope of the invention, but rather as an exemplification of one preferred embodiment thereof. Many other variations will be apparent to those skilled in the art.

I claim:

1. A safety lock for single hung windows comprising;

(1) first and second tubes, said second tube slidably movable into and out of a first end of said first tube;

(2) a plurality of holes positioned lengthwise of said first tube;

(3) means to support a second end of said first tube adapted to present rotation of said tube about its axis but to permit movement through at least 90 degrees from right angle to said means;

(4) a hole near an end of the second tube which is inserted into said first tube;

(5) a spring loaded push button adapted to extend through said hole in said second tube and a selected hole in said first tube; and (6) means to support a bar to a window frame, a second end of said second tube being provided with two L-shaped slots which releasably engage said bar.

2. The lock of claim 1 wherein said two L-shaped slots releasably engage said bar by moving said second tube toward said bar so that said bar is inserted into said L-shaped slots and then rotating said second tube so that said button extends into a hole in said first tube.

3. The lock of claim 1 wherein a second hole is provided in said second tube.

4. A safety lock for single hung windows and at various open positions comprising;

(1) first and second tubes, said second tube slidably movably into and out of the first end of said first tube;

(2) a plurality of holes positioned lengthwise of said first tube;

(3) holes near a second end of said first tube adapted to receive fastening means therethrough;

(4) a first support plate having two upwardly projecting flanges, each of said upwardly projecting flanges having a hole therein adapted to line up with the holes in the second end of said first tube;

(5) a rivet adapted to extend through the holes in said upwardly projecting flanges and the holes in the second end of said first tube;

(6) a hole near an end of the second tube which is inserted into said first tube;

(7) a spring loaded push button adapted to extend through said hole in said second tube and a selected hole in said first tube;

(8) a second support plate having two downwardly projecting flanges, said downwardly projecting flanges having aligned holes therein;

(9) a second rivet extending through holes in said downwardly projecting flanges;

(10) two L-shaped slots in an end of said second tube opposite the end which inserts into said first tube, said slots adapted to allow said second rivet to enter said L-shaped slots and said second tube to be rotated to a locked position wherein said push button is aligned with holes positioned lengthwise of said first tube.

5. The lock of claim 4 wherein said support plates are provided with adhesive strips for attachment.

* * * * *